US011732870B2

(12) United States Patent
Liu et al.

(10) Patent No.: US 11,732,870 B2
(45) Date of Patent: Aug. 22, 2023

(54) LIGHT DISTRIBUTION ELEMENT AND LAMP COMPRISING THE SAME

(71) Applicants: OPPLE LIGHTING CO., LTD., Shanghai (CN); SUZHOU OPPLE LIGHTING CO., LTD., Suzhou (CN)

(72) Inventors: Chaobo Liu, Suzhou (CN); Hongbo Wang, Suzhou (CN); Qingjun Wei, Suzhou (CN)

(73) Assignee: Opple Lighting Co., Ltd., Shanghai (CN)

( * ) Notice: Subject to any disclaimer, the term of this patent is extended or adjusted under 35 U.S.C. 154(b) by 0 days.

(21) Appl. No.: 17/566,608

(22) Filed: Dec. 30, 2021

(65) Prior Publication Data

US 2022/0120411 A1 Apr. 21, 2022

Related U.S. Application Data

(63) Continuation of application No. PCT/CN2020/126208, filed on Nov. 3, 2020.

(30) Foreign Application Priority Data

Nov. 7, 2019 (CN) ..... 201911084218.9
Nov. 7, 2019 (CN) ..... 201921913615.8

(51) Int. Cl.
*F21V 5/04* (2006.01)
*F21Y 115/10* (2016.01)

(52) U.S. Cl.
CPC ..... *F21V 5/048* (2013.01); *F21Y 2115/10* (2016.08)

(58) Field of Classification Search
CPC . F21V 5/048; F21V 5/00; F21V 5/046; F21V 5/08; F21V 5/04; F21V 5/007; F21Y 2115/10
See application file for complete search history.

(56) References Cited

U.S. PATENT DOCUMENTS

2011/0140589 A1* 6/2011 Daniel ..... F21K 9/232 313/110

FOREIGN PATENT DOCUMENTS

| | | | |
|---|---|---|---|
| CN | 201852036 | U | 6/2011 |
| CN | 107654860 | A | 2/2018 |
| CN | 208124085 | U | 11/2018 |
| CN | 209415215 | U | 9/2019 |
| CN | 110715268 | A | 1/2020 |
| CN | 210688094 | U | 6/2020 |
| WO | 2013057632 | A1 | 4/2013 |

OTHER PUBLICATIONS

International Search Report of PCT Application No. PCT/CN2020/126208 dated Feb. 1, 2021 with English translation, (6p).

* cited by examiner

*Primary Examiner* — Bao Q Truong
(74) *Attorney, Agent, or Firm* — Arch & Lake LLP

(57) ABSTRACT

A light distribution element and a lamp are provided. The lamp includes a plurality of subsections combined with each other, each of the plurality of subsections is a part of a circumference, and the plurality of subsections can be located on at least one virtual circumference by movement. The light distribution element of the present application includes a plurality of subsections combined with each other, which is favorable for providing the lamp with a special-shaped configuration, thus facilitating the use of the lamp.

17 Claims, 16 Drawing Sheets

Total collective power=3097.0 lm
Efficiency=0.97098
Maximum intensity=2526.3 cd

Total collective power=3097.4 lm
Efficiency=0.97110
Maximum intensity=2558.9 cd

Total collective power=6194.2 lm
Efficiency=0.97100
Maximum intensity=4936.2 cd

Total collective power=6194.3 lm
Efficiency=0.97102
Maximum intensity=4923.6 cd

LIGHT DISTRIBUTION ELEMENT AND LAMP COMPRISING THE SAME

CROSS-REFERENCE TO RELATED APPLICATIONS

The present application is a continuation of PCT patent application No. PCT/CN2020/126208 filed on Nov. 3, 2020 which is based upon and claims the priority of Chinese patent application No. 201911084218.9 filed on Nov. 7, 2019 and Chinese patent application No. 201921913615.8 filed on Nov. 7, 2019, the entire contents of which are incorporated herein by reference for all purposes.

TECHNICAL FIELD

The present application relates to the field of lighting, in particular to a light distribution element. The present application also relates to a lamp comprising the light distribution element.

BACKGROUND

Light-emitting diode lamps possess advantages of energy saving, high emitting efficiency, rich colors, long service life and the like, and hence have always been popular in consumers. In order to meet the requirements on the lighting effect of LED lamps, it is necessary to provide light distribution elements on LED lamps.

SUMMARY

The present application provides a light distribution element and a lamp including the light distribution element. The light distribution element of the present application includes a plurality of subsections combined with each other, which is favorable for providing the lamp with a special-shaped configuration, thus facilitating its use in a special-shaped space.

In a first aspect of the present application, the light distribution element includes a plurality of subsections combined with each other, each of the plurality of subsections is a part of a circumference, wherein the plurality of subsections can be located on at least one virtual circumference by movement.

In a second aspect of the present application, the lamp includes a plurality of light emitters and the light distribution element described above; the plurality of light emitters are arranged corresponding to the plurality of subsections; the lamp further includes a lamp panel on which the plurality of light emitters are fixed, and the light distribution element is fixedly engaged with the lamp panel to cover the corresponding light emitters.

BRIEF DESCRIPTION OF THE DRAWINGS

The drawings described herein are used to provide further understanding of the present application and constitute a part of the present application. Illustrative examples of the present application and description thereof are used to explain the present application, and do not constitute any improper limit to the present application. In the drawings.

DETAILED DESCRIPTION

In order to make the objective(s), the technical solution(s) and advantages of the present application more apparent, the technical solution(s) of the present application will be described clearly and completely with reference to embodiments of the present application and corresponding drawings hereinafter. It will be apparent that the embodiments described are only some but not all of the embodiments of the present application. Based on the embodiments in the present application, all the other embodiments obtained by those of ordinary skill in the art without making inventive efforts should also fall within the scope claimed by the present application.

Figure 1:
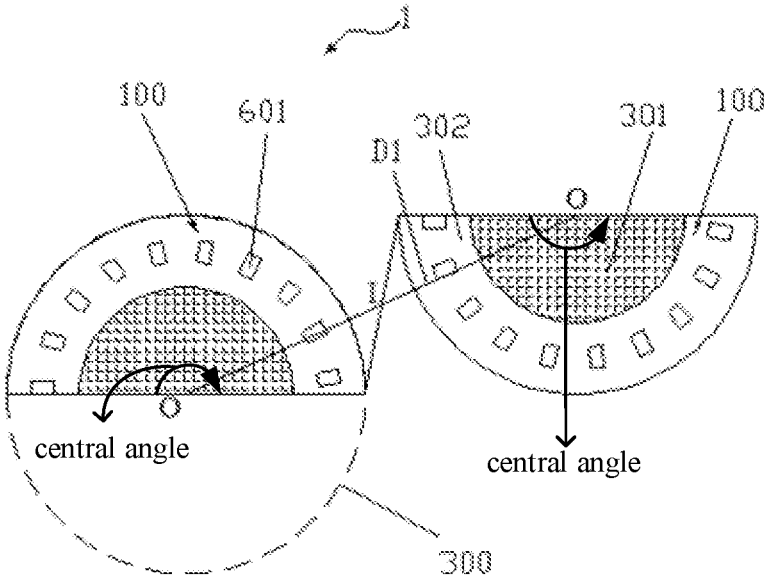
FIG. 1 schematically illustrates a configuration of a light distribution element according to a first example of the present application.

FIG. 1 schematically illustrates a configuration of a light distribution element 1 according to a first example of the present application. As shown in FIG. 1, the light distribution element 1 includes a plurality of subsections 100 combined with each other, each of the plurality of subsections 100 is a part of a circumference. These subsections 100 can be located on at least one virtual circumference 300 simply by movement. In one example, these subsections 100 are moved to form one or more virtual circumferences 300. In another example, these subsections 100 can be located on at least one virtual circumference 300 simply by translation, or these subsections 100 can form one or more virtual circumferences 300 simply by translation, as further described below.

In the present application, the term "translation" refers to moving every point of the subsection 100 towards the same direction by the same distance. It should be understood that the translation used herein can be at least a left-right translation, an up-down translation or a combination thereof. For example, firstly, the subsection 100 at the right side is translated downward to an appropriate position, and then translated leftward to an appropriate position. In this example, the two subsections 100 can be spliced to form a virtual circumference 300 by translation, and the virtual circumference 300 has a circumferential angle of 360°. It has been found through tests that this may contribute to ensuring the lighting effect of the lamp 6.

Figure 2:
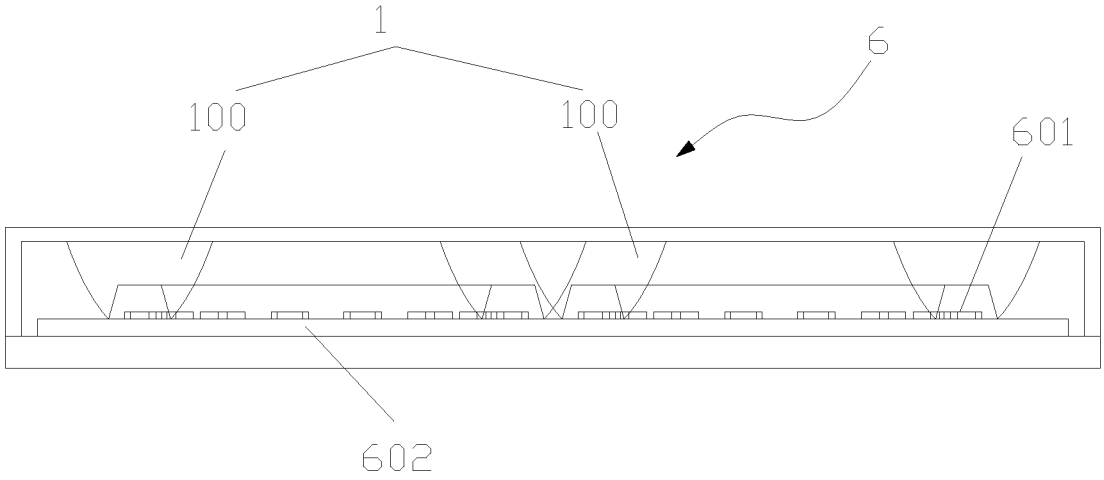
FIG. 2 schematically illustrates a lamp according to one example of the present application.

FIG. 2 schematically illustrates a lamp 6 according to one example of the present application. The lamp 6 includes a plurality of light emitters 601 and the light distribution element 1 described above, and the plurality of light emitters 601 are arranged corresponding to the plurality of subsections 100. In a specific example, the light emitters 601 are disposed at a density of 2-5 per centimeter along a circumferential extension direction of the subsection 100, i.e., the light emitters 601 have a circumferential density of 2-5 per centimeter along the circumferential extension direction of the subsection 100.

Also, as shown in FIG. 2, the lamp 6 further includes a lamp panel 602 on which the plurality of light emitters 601 are fixed, and the light distribution element 1 is fixedly engaged with the lamp panel 602 to cover the corresponding light emitters 601. The lamp panel 602 can be used to supply power to the light emitters 601.

For example, under the same lighting requirement, the lamp 6 (as shown in FIG. 2) equipped with the light distribution element 1 shown in FIG. 1 exhibits a lighting effect identical or almost identical to the lamp with a circular or annular light distribution element in the prior art, i.e., exhibiting identical or almost identical optical properties. Therefore, given the same optical properties, the light distribution element 1 can be formed as an adaptive configuration as desired, so as to provide a flexibility for designing the structures and sizes of the light distribution element and the lamp. Particularly, the light distribution element 1 of the present application is very beneficial for the lamp 6 intended to be installed in a special-shaped space, such as a long and narrow space or a curved space, because the light distribution element 1 can be formed into a long and narrow shape or a curved shape by the combination of a plurality of subsections 100, allowing the lamp 6 to be adaptive to such a space.

In one or more examples, the shape formed by mutual combination of a plurality of subsections 100 is a symmetric shape. In this way, the light distribution element 1 and the lamp 6 can also have symmetric shapes, which further contributes to the lighting effect of the lamp 6. It should be understood that the symmetric shape described herein can be an axisymmetric shape or a rotationally symmetric shape. For example, as shown in FIG. 1, the light distribution element 1 is rotationally symmetric, and has a center of rotational symmetry indicated by "I". It should be understood that the rotational symmetry described herein can be achieved simply by translating these subsections 100, without the need of rotating these subsections 100, to locate these subsections 100 on the virtual circumference 300.

In other examples, a plurality of subsections 100 can also be combined with each other to form an asymmetric shape. In this case, it is possible to adjust and/or ensure the lighting effect of the lamp 6 by providing different light emitters for different subsections 100. Of course, the lighting effect of the lamp 6 may not need to be adjusted, as required.

In the example shown in FIG. 1, the light distribution element 1 is composed of two independent semi-circular subsections 100 (i.e., the central angle is 180°), which are horizontally spaced apart and can form a virtual circumference 300 simply by translation. A distance (i.e., center distance) D1 between centers of two subsections 100 is greater than the sum of the radii of the two subsections 100. Therefore, the lamp 6 equipped with the light distribution element 1 may have a long and narrow shape.

In one example, the central angles of the plurality of subsections 100 may be identical. Thus, these subsections 100 can be conveniently configured to form a light distribution element 1 with a symmetric shape, which contributes to ensuring the lighting effect of the lamp 6. Preferably, the central angle is 45° or more. For example, the central angle may be 45°, 60°, 75°, 90°, 120°, 145°, 160°, 180°, etc. Thus, the subsection 100 may have an appropriate circumferential length, which facilitates the arrangement of light emitters corresponding to the subsections 100.

In one example, the diameters of the plurality of subsections 100 may be identical. In other words, a plurality of subsections 100 can be located on the same virtual circumference simply by translation, or can be spliced to form one or more complete circumferences in case of sufficient amount of subsections 100. This further contributes to forming a symmetric shape by the plurality of subsections 100. In one or more examples, in a shape formed by mutual combination of a plurality of subsections 100, the ratio of a center distance D1 between two subsections 100 with the farthest distance to a diameter of the virtual circumference 300 is greater than or equal to 1:1 and less than or equal to 5:1. Compared with the corresponding existing lamps equipped with a light distribution element having a complete circumference and/or partial circumference (for example, forming such a light distribution element of a lamp amounts to splicing these subsections 100 simply through translation), the lamp 6 equipped with the light distribution element 1 having the structure according to the present application has a larger length-width ratio, and exhibits a lighting effect identical or almost identical to the corresponding existing lamps, and thus can be conveniently used in a narrow installation space.

In another example, the central angle of at least one subsection 100 is not equal to that of the remaining subsections 100. For example, a part of these subsections 100 may have a central angle of 45°, and another part of these subsections 100 may have a central angle of 90°, and further another part of these subsections 100 may have a central angle of 180°. In other words, the subsections 100 provide greater diversity in the circumferential length so as to make up more combinations, thus providing greater diversity in the shapes of the light distribution element 1 and the corresponding lamp 6, which may further contribute to the installation and use of the lamp 6. In this case, preferably, the number of subsections 100 is greater than or equal to 3, and subsections with larger central angles are distributed around peripheries of subsections with smaller central angles. It has been unexpectedly found that, with this structure, in the lamp 6, the subsections with larger central angles and the subsections with smaller central angles can compensate each other in terms of guiding light, thus ensuring the lighting effect of the lamp 6.

In another example, among the plurality of subsections, the diameter of at least one subsection is smaller than that of the remaining subsections. For example, a part of these subsections 100 may have a diameter of 50 mm, another part of these subsections 100 may have a diameter of 80 mm, and further another part of these subsections 100 may have a diameter of 30 mm. In the case of different central angles, choosing the subsections with different diameters can provide greater diversity in the circumferential length of the subsections so as to make up more combinations, thus providing greater diversity in the shapes of the light distribution element 1 and the corresponding lamp 6, which may further contribute to the installation and use of the lamp 6.

In one example, in the lamp 6, a larger number of light emitters 601 can be arranged corresponding to the subsections with larger diameters, and a larger number of light emitters 601 can be arranged corresponding to the subsections with smaller diameters. In this case, preferably, the number of the plurality of subsections is greater than or equal to 3, and subsections with larger diameter are distributed around peripheries of subsections with smaller diameter. In this way, in the lamp 6, the subsection with larger diameter and the subsection with smaller diameter will also compensate with each other in terms of light emission, thus ensuring the lighting effect of the lamp 6. For example, when subsections with smaller diameters are alternately arranged between subsections with larger diameters, since the subsections with larger diameters are arranged with larger spacing, the subsections with smaller diameters can compensate for the dark areas between subsections with larger diameters, thus ensuring the lighting effect of the lamp 6. Therefore, the lamp 6 equipped with the light distribution element 1 having the structure according to the present application has a larger length-width ratio, and exhibits a lighting effect identical or almost identical to the corresponding existing lamps, and thus can be conveniently used in a narrow installation space.

In the case that the diameters of the subsections are not completely the same, in the shape formed by mutual combination of a plurality of subsections, the ratio of the center distance between two subsections with the farthest distance to the diameter of the virtual circumference with the largest diameter is greater than or equal to 1:1 and less than or equal to 10:1. For example, the ratio can be 1:1, 5:1, 8:1 or 10:1. With this structure, the lamp still exhibits a good lighting effect.

In one example, at least one of the plurality of subsections 100 includes a light-shielding region 301 close to the center O of the circumference and a light-transmitting region 302 radially outside the light-blocking region 301. In the lamp 6, the light-shielding region 301 can be used to shield the interior of the lamp 6, especially the components and wiring disposed on the light source board, so as to modify the aesthetics of the lamp 6. In a specific example, a refraction pattern is constructed in the light-shielding region 301 to realize light shielding.

EXAMPLES

The subsection modes and their combinations in the light distribution elements will be described with specific examples below. In addition, the optical parameters of lamps equipped with these light distribution elements are also tested, as shown in Table 1.

Figure 6A:
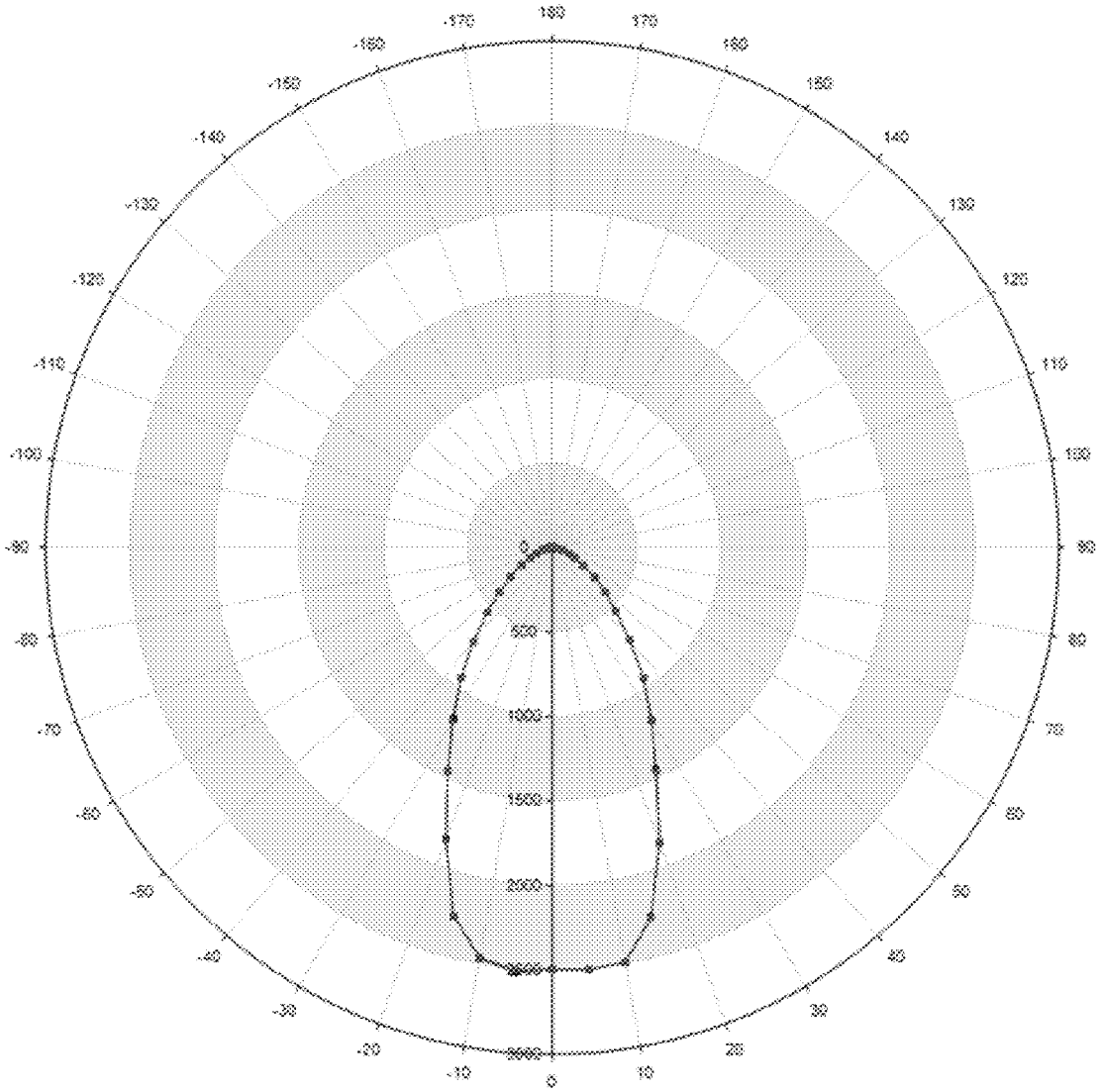
FIGS. 6A-6J are light distribution curves of Examples 1-8 and Comparative Examples 1-2.

Example 1: As shown in FIG. 1, the light distribution element 1 is composed of two independent subsections 100 not in contact with each other, with a center of rotational symmetry indicated by "I". Each of the central angles of the subsections 100 is 180°, and the light emitters of the subsections 100 have a circumferential density of 3 per centimeters. The two subsections 100 can form a virtual circumference 300 simply by translation. A center distance D1 between the two subsections 100 is 60 mm, and a diameter of the virtual circumference 300 is 50 mm. The light distribution curve is shown in FIG. 6A.

Figure 3A:
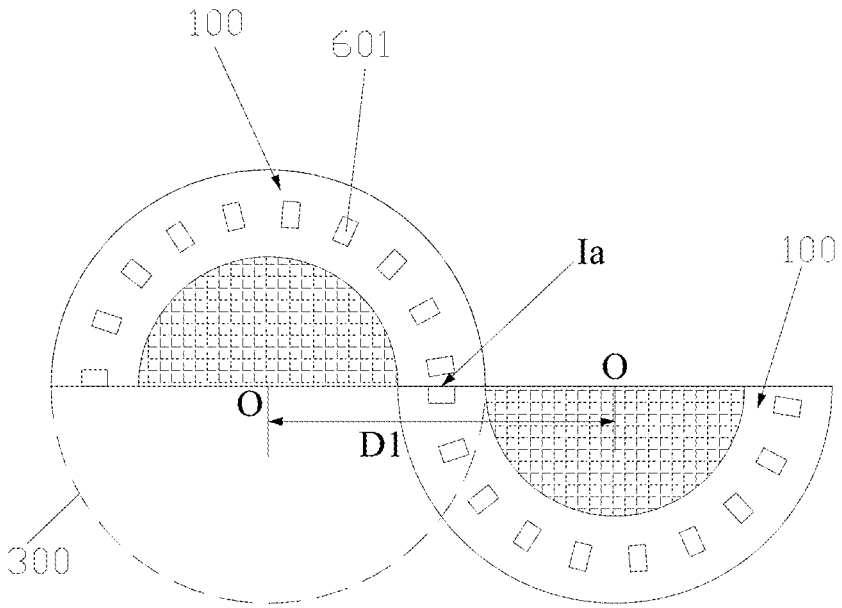
FIGS. 3A-3G schematically illustrate various other configurations of a light distribution element according to the present application.
Figure 6B:
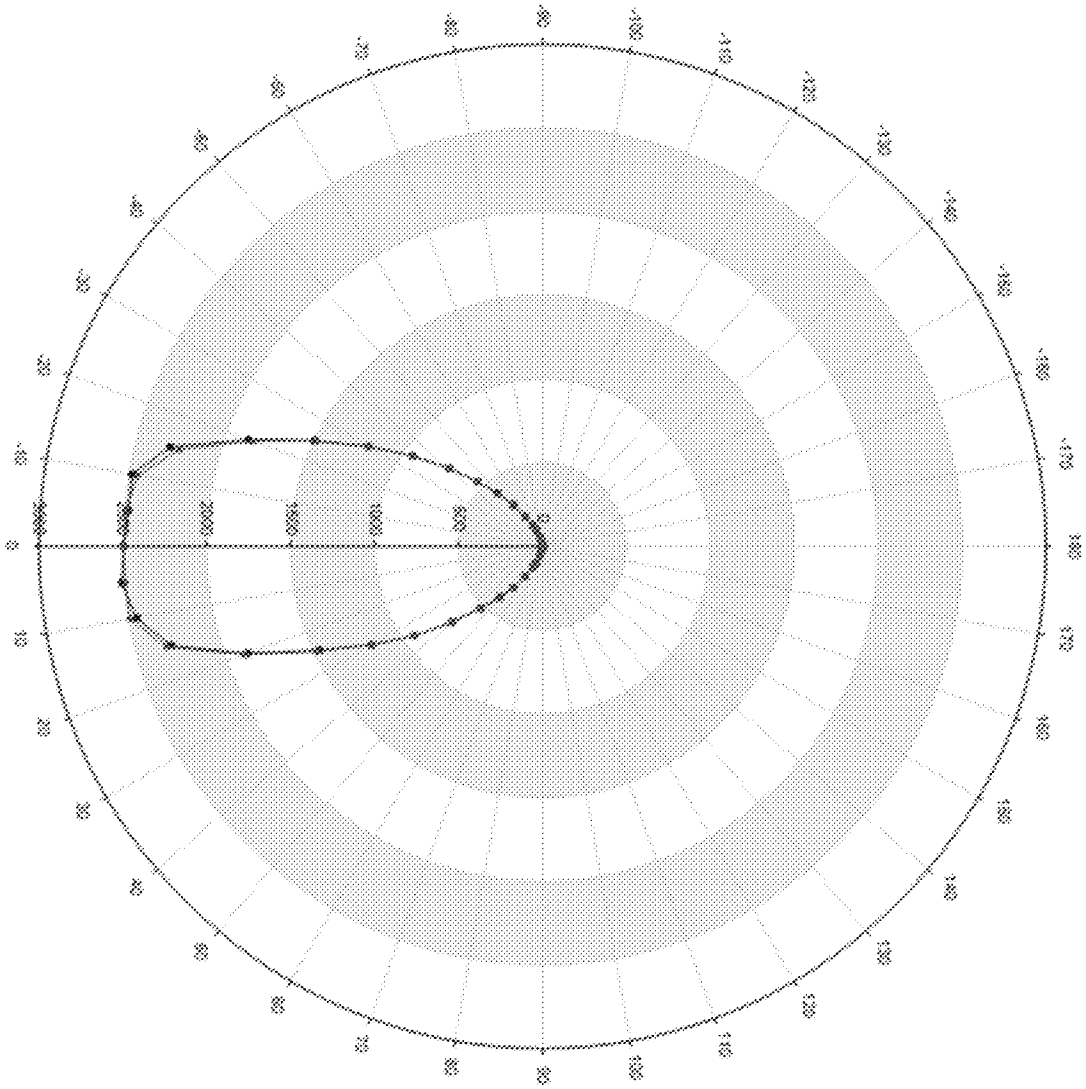

Example 2: As shown in FIG. 3A, the light distribution element is composed of two independent subsections 100 which are in contact with each other and form the shape of the capital letter "S", with the center of rotational symmetry indicated by "Ia". Each of the central angles of the subsections 100 is 180°, and the light emitters 601 of the subsections 100 have a circumferential density of 3 per centimeters. The two subsections 100 can form a virtual circumference 300 simply by translation. The center distance D1 between the two subsections 100 is 40 mm, and the diameter of the virtual circumference 300 is 50 mm. The light distribution curve is shown in FIG. 6B.

Figure 3B:
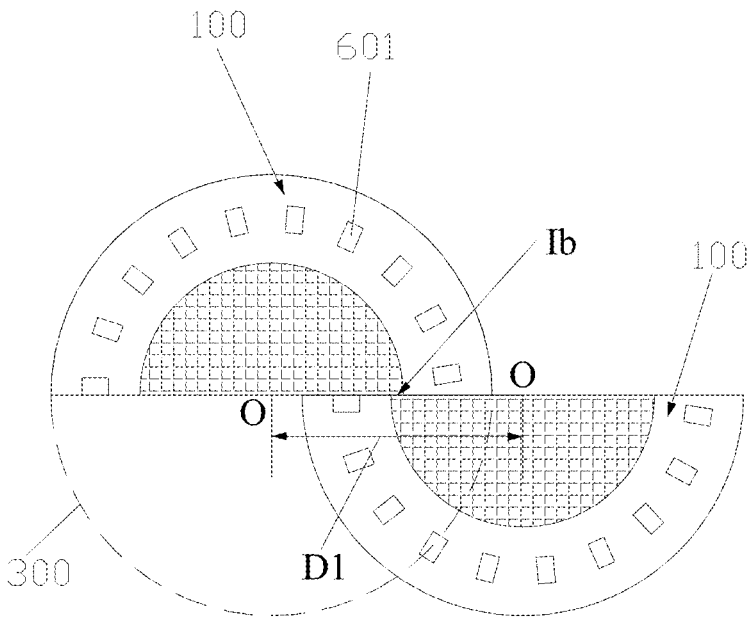
Figure 6C:
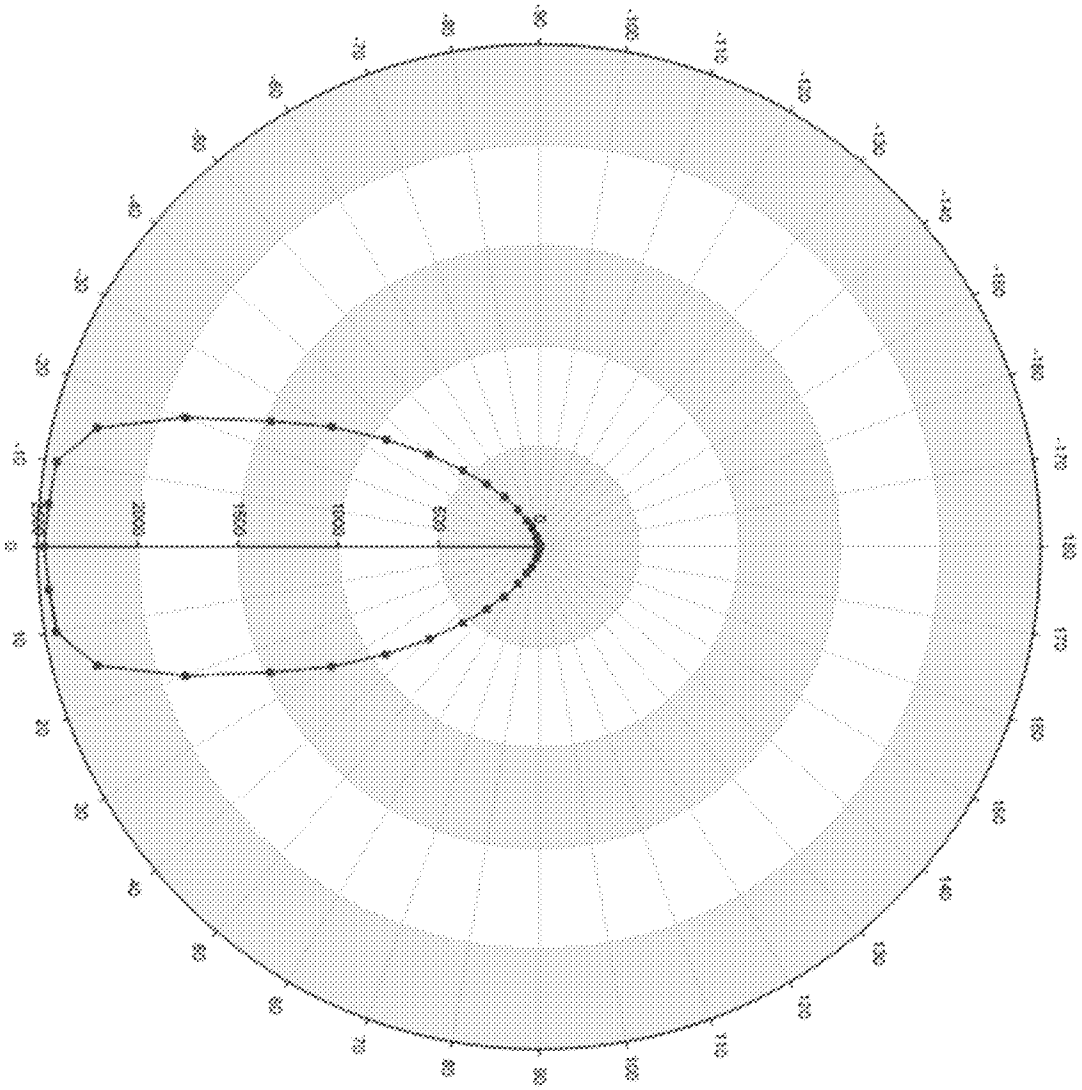

Example 3: As shown in FIG. 3B, the light distribution element is composed of two independent subsections 100 in contact with each other, with the center of rotational symmetry indicated by "Ib". Each of the central angles of the subsections 100 is 180°, and the light emitters of the subsections 100 have a circumferential density of 3 per centimeters. The two subsections 100 can form a virtual circumference 300 simply by translation. The center distance D1 between the two subsections 100 is 30 mm, and the diameter of the virtual circumference 300 is 50 mm. The light distribution curve is shown in FIG. 6C.

Figure 3C:
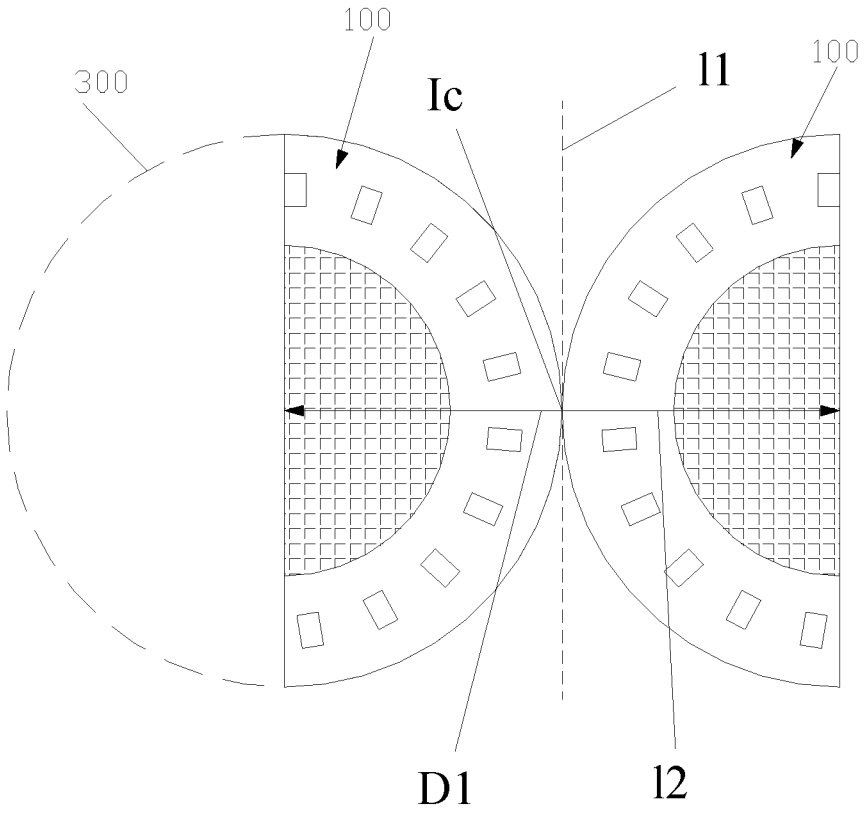
Figure 6D:
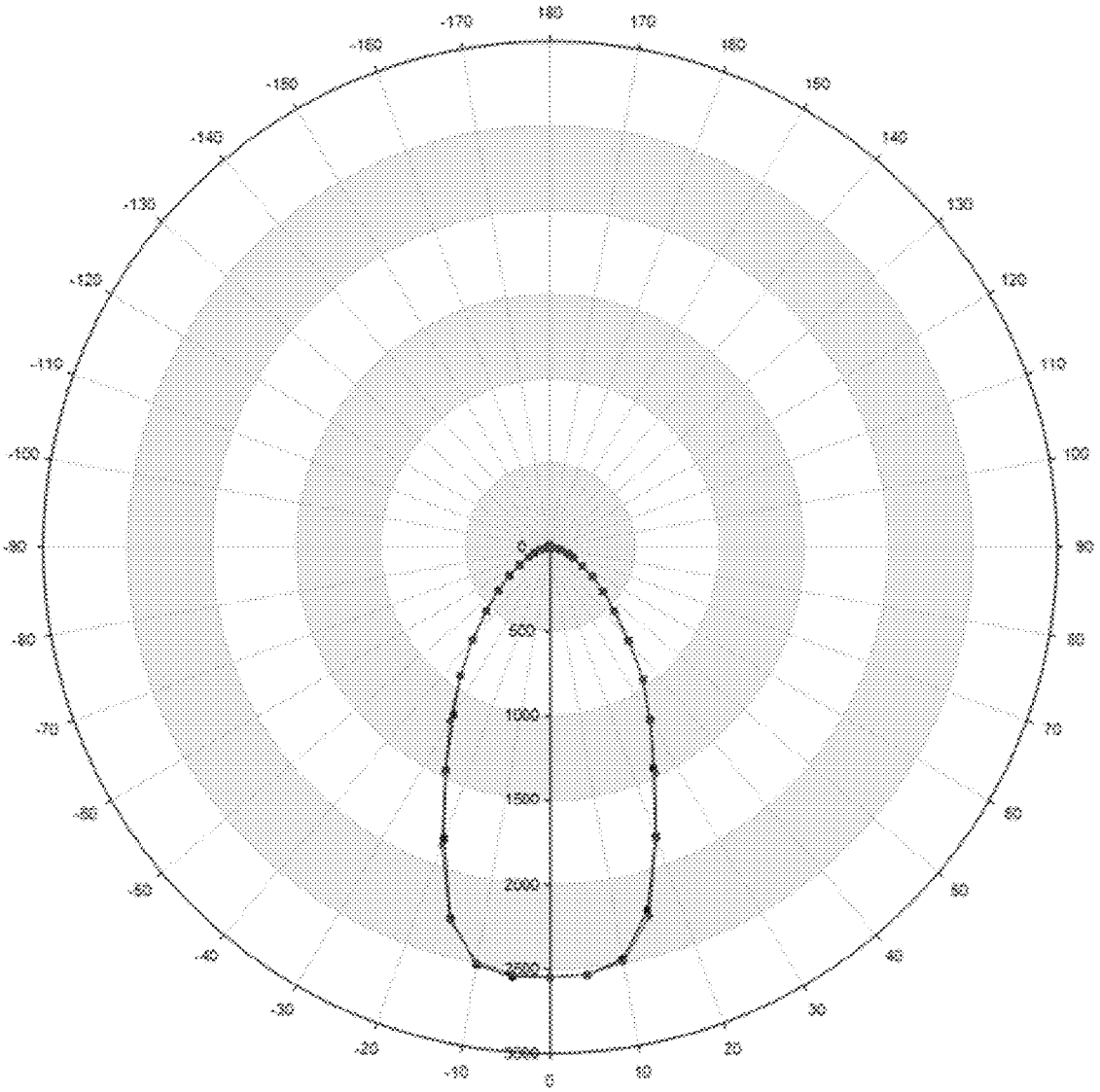

Example 4: As shown in FIG. 3C, the light distribution element is composed of two independent subsections 100 in contact with each other, have a symmetry axis 11 and a symmetry axis 12, and have a center of rotational symmetry indicated by "Ic". Each of the central angles of the subsections 100 is 180°, and the light emitters of the subsections 100 have a circumferential density of 3 per centimeters. The two subsections 100 can form a virtual circumference 300 simply by translation. The center distance D1 between the two subsections 100 is 50 mm, and the diameter of the virtual circumference 300 is 50 mm. The light distribution curve is shown in FIG. 6D.

Figure 3D:
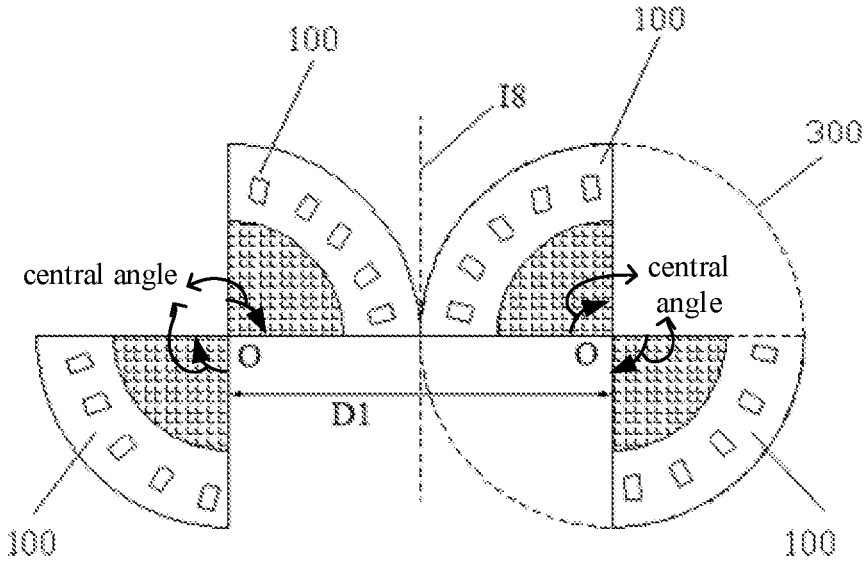
Figure 6E:
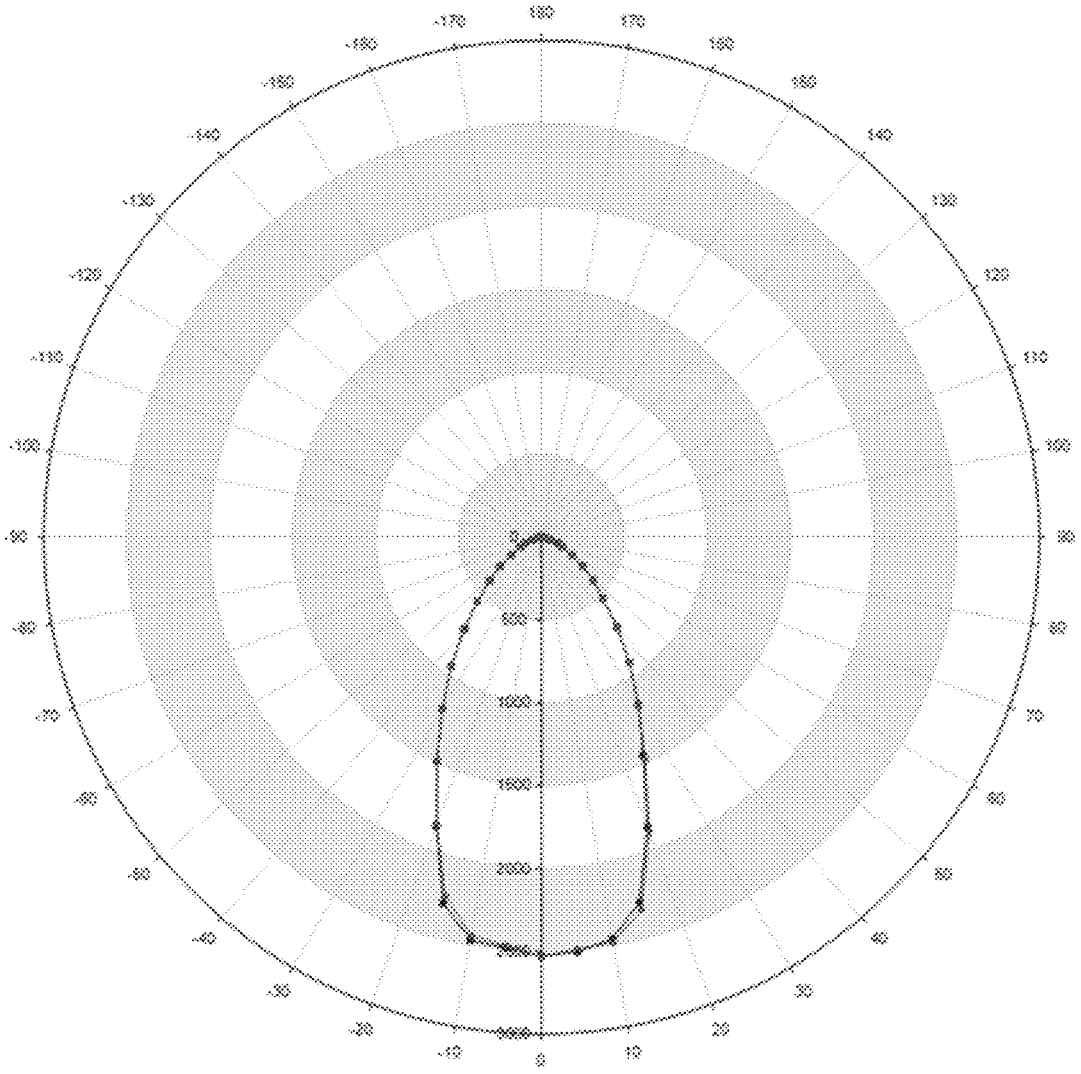

Example 5: As shown in FIG. 3D, the light distribution element is composed of four independent subsections 100 in contact with each other, with a symmetry axis indicated by "18". Each of the central angles of the four subsections 100 is 90°, and the light emitters of the subsections 100 have a circumferential density of 3 per centimeters. These subsections 100 can form a virtual circumference 300 simply by translation. The center distance D1 between the two subsections 100 with the farthest distance is 50 mm, and the diameter of the virtual circumference 300 is 50 mm. The light distribution curve is shown in FIG. 6E.

Figure 3E:
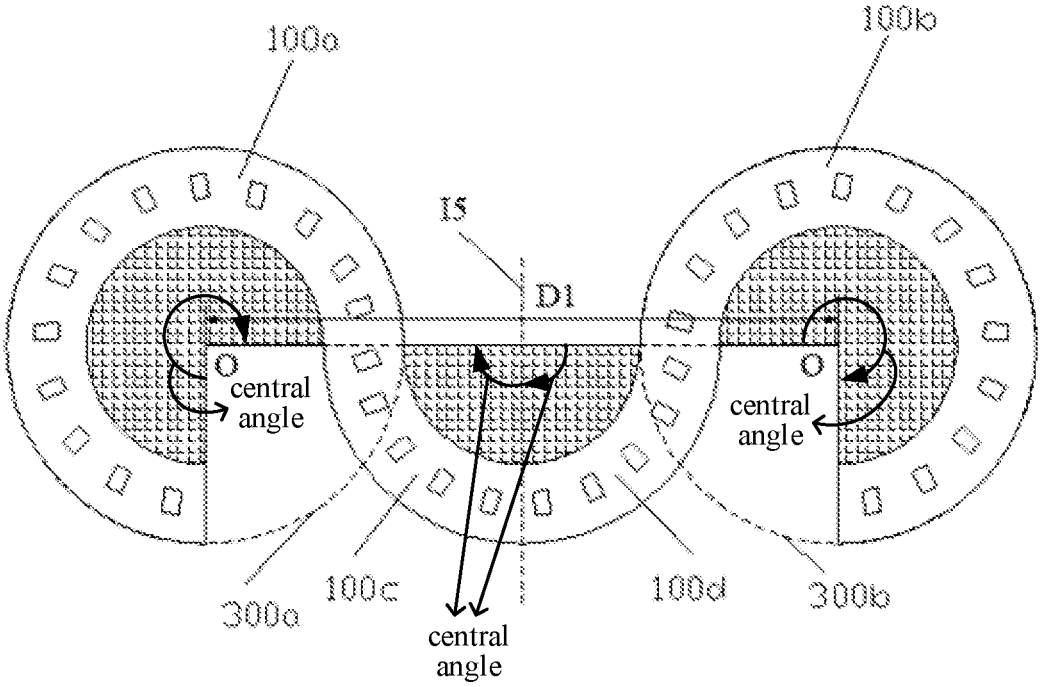
Figure 6F:
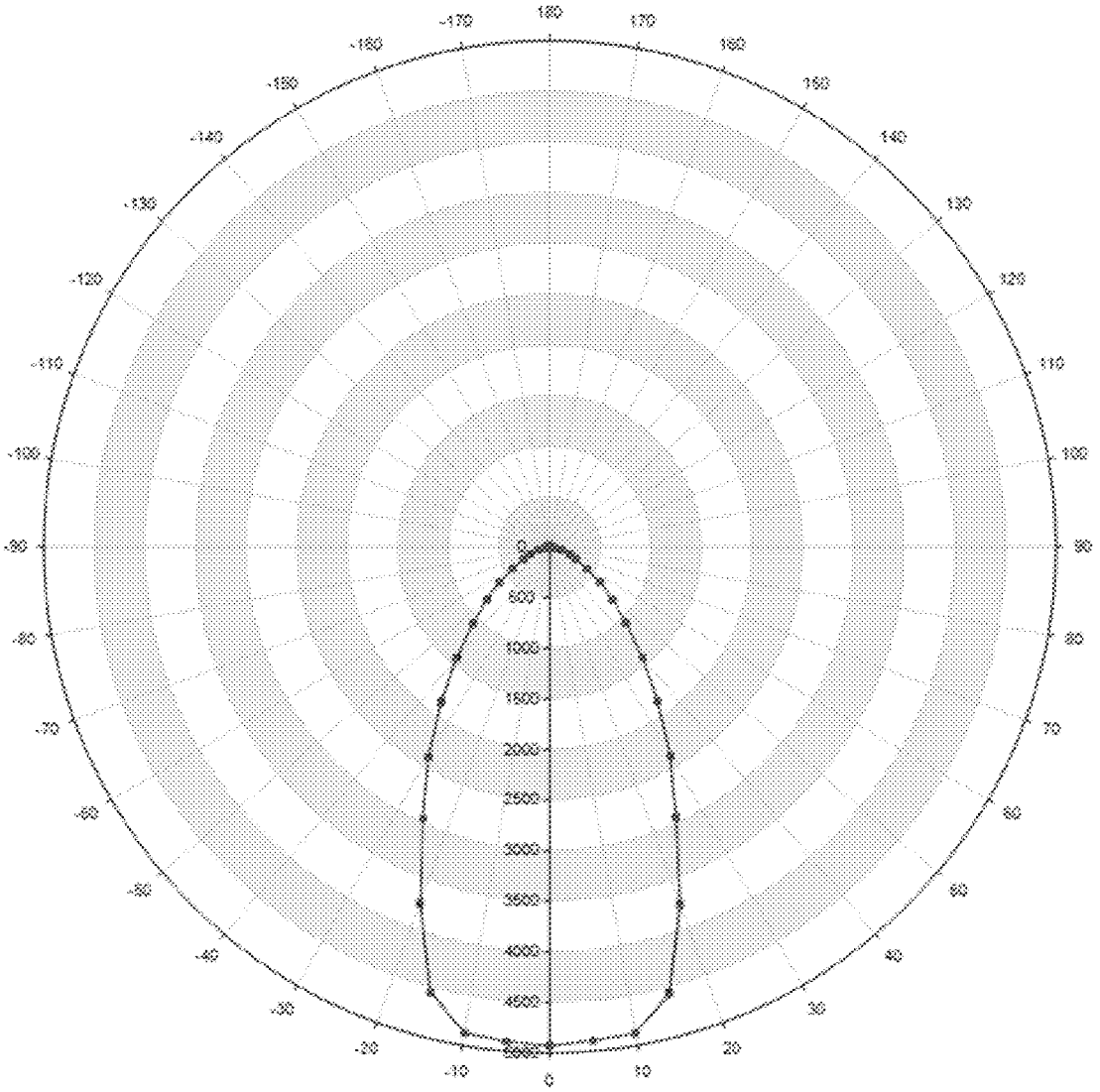

Example 6: As shown in FIG. 3E, the light distribution element is composed of four independent subsections in contact with each other, with a symmetry axis indicated by "15". Each of the central angles of subsections 100*a* and 100*b* is 270°, and the circumferential density of light emitters of subsections 100*a* and 100*b* is 4 per centimeters; each of the central angles of subsections 100*c* and 100*d* is 90°, and the circumferential density of light emitters of subsections 100*c* and 100*d* is 4 per centimeters. Subsections 100*a*, 100*b* and subsections 100*c*, 100*d* can form virtual circumferences 300*a* and 300*b* simply by translation. The center distance D1 between subsections 100*a* and 100*b* is 80 mm, and the diameter of the virtual circumference 300*a* (or 300*b*) is 50 mm. The light distribution curve is shown in FIG. 6F.

Figure 3F:
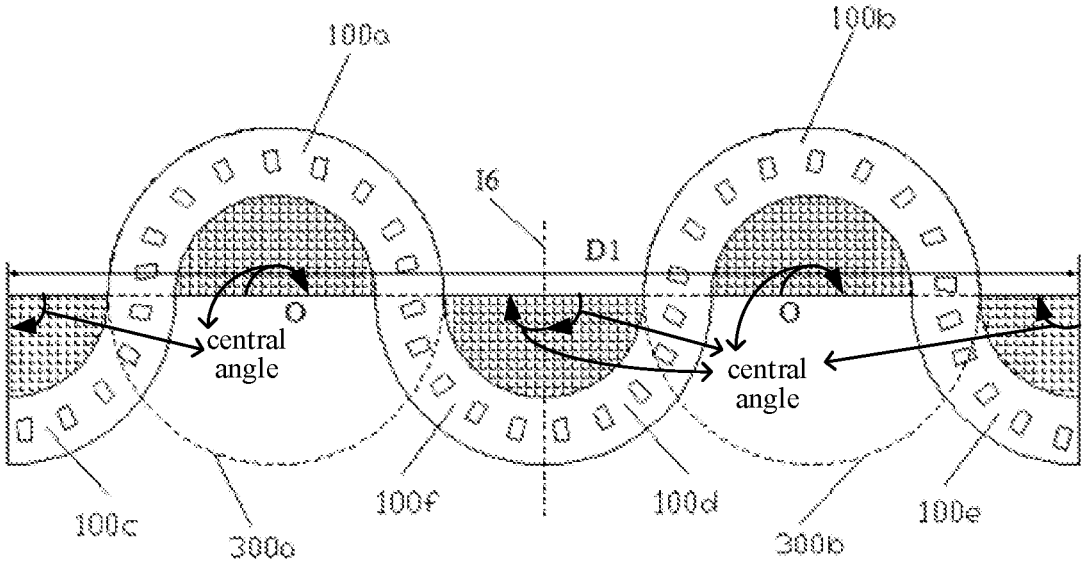
Figure 6G:
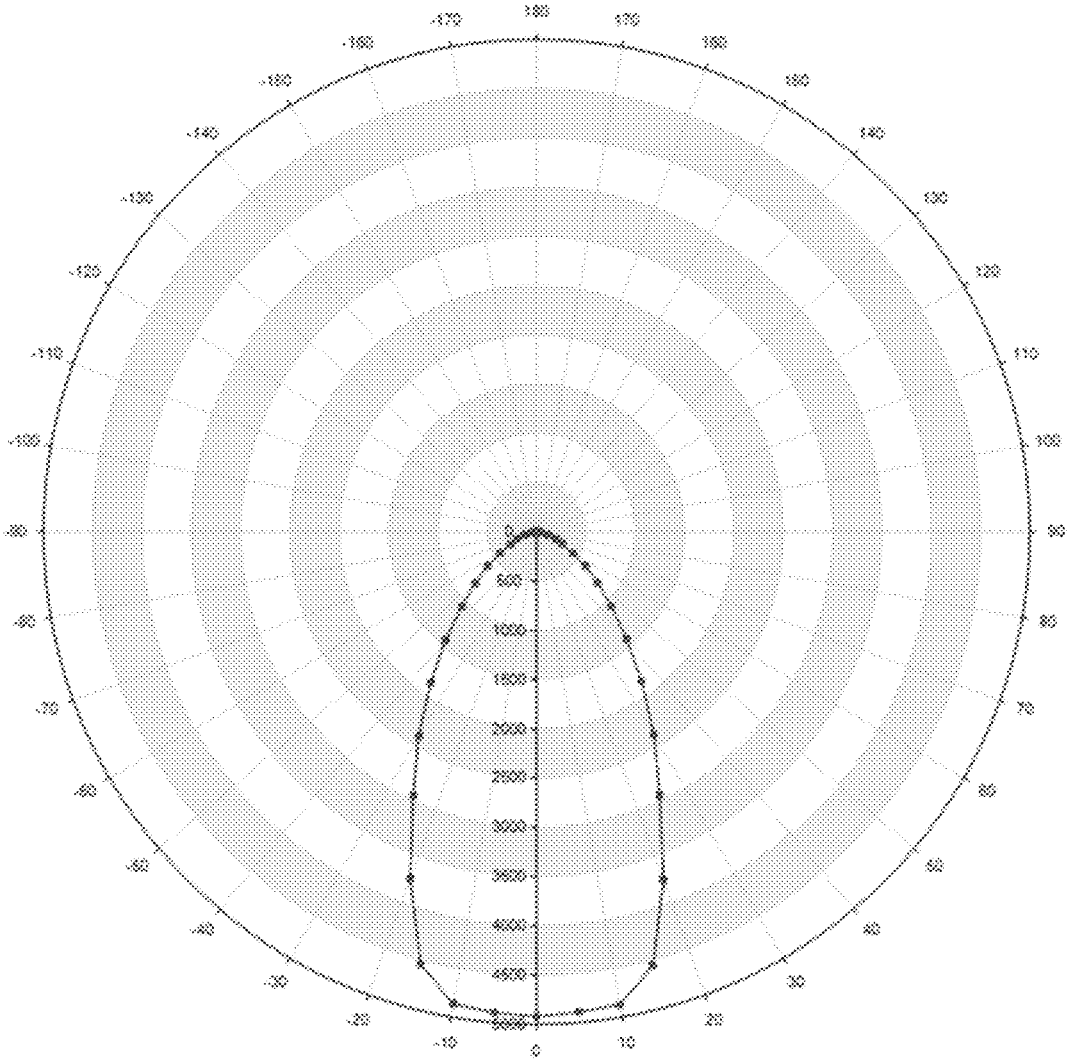

Example 7: As shown in FIG. 3F, the light distribution element is composed of six independent subsections 100 in contact with each other, with a symmetry axis indicated by "16". Each of the central angles of subsections 100*a* and 100*b* is 180°, and the circumferential density of light emitters is 4 per centimeters; each of the central angles of subsections 100*c*, 100*d*, 100*e* and 100*f* is 90°, and the circumferential density of light emitters is 4 per centimeters. The virtual circumferences 300*a* and 300*b* can be formed simply by translating all subsections 100*a*-100*f*. The center distance D1 between subsections 100*c* and 100*e* is 140 mm, and the diameter of the virtual circumference 300*a* (or 300*b*) is 50 mm. The light distribution curve is shown in FIG. 6G.

Figure 3G:
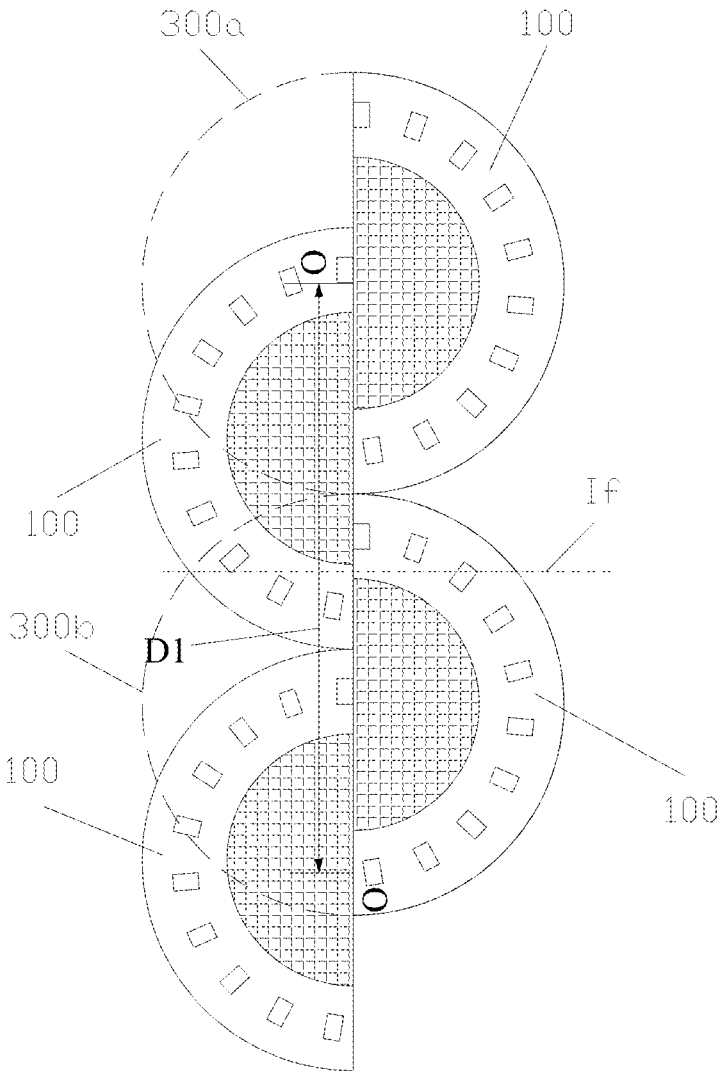
Figure 6H:
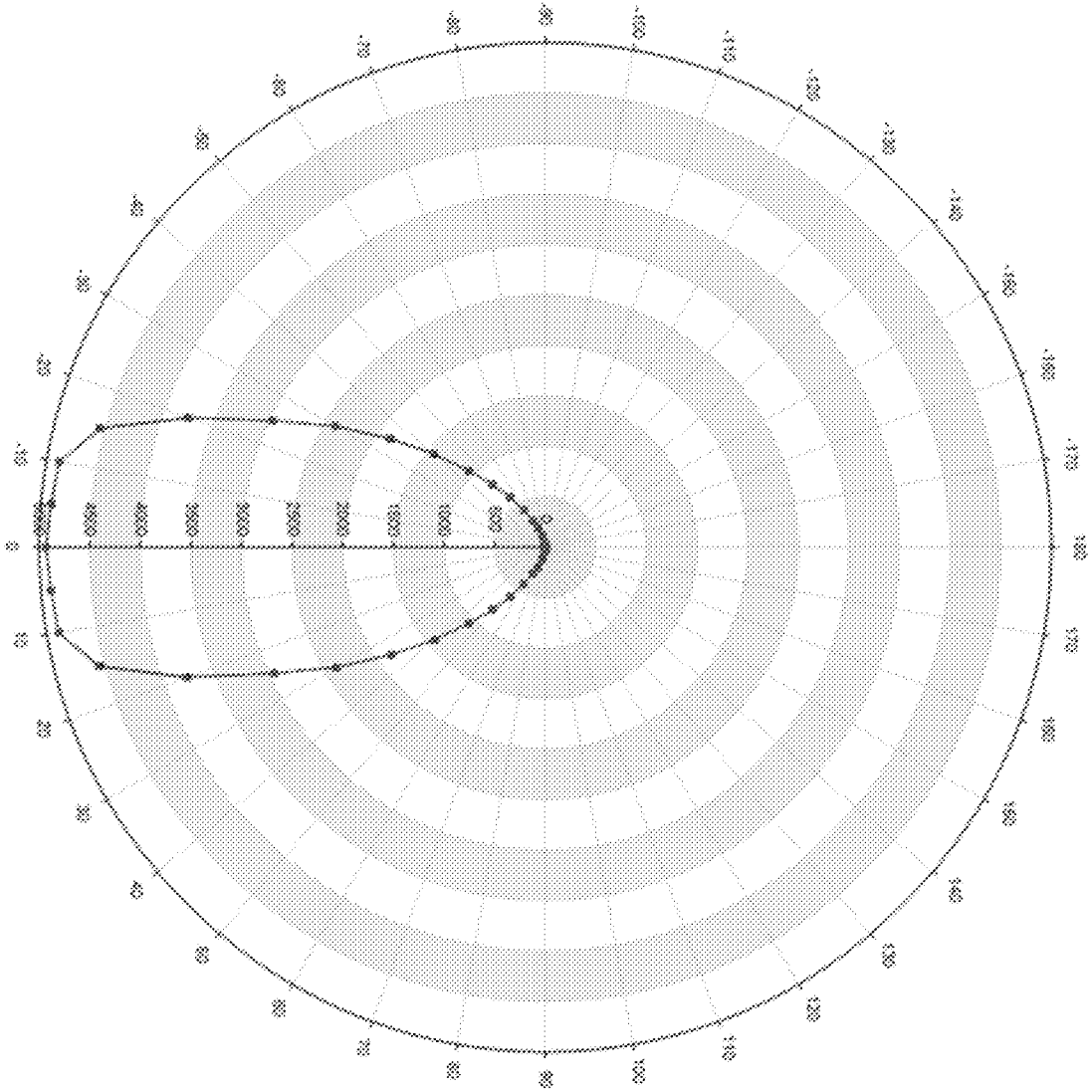

Example 8: As shown in FIG. 3G, the light distribution element is composed of four independent subsections 100 in contact with each other, with a center of rotational symmetry indicated by "If". Each of the central angles of the four subsections 100 is 180°, and the circumferential density of light emitters of the subsections 100 is 4 per centimeters. These subsections 100 can form virtual circumferences 300*a* and 300*b* simply by translation. The center distance D1 between the two subsections 100 with the farthest distance is 70 mm, and the diameter of the virtual circumference 300*a* (or 300*b*) is 50 mm. The light distribution curve is shown in FIG. 6H.

Figure 4:
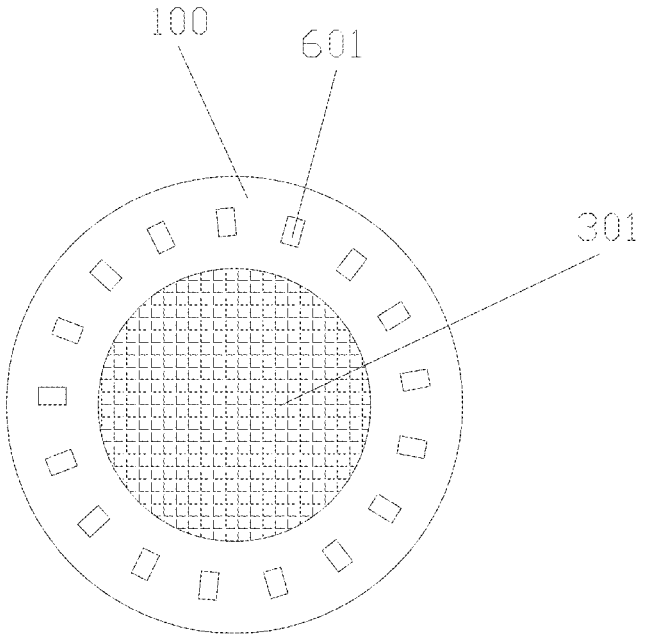
FIG. 4 schematically illustrates a light distribution element in the prior art.
Figure 6I:
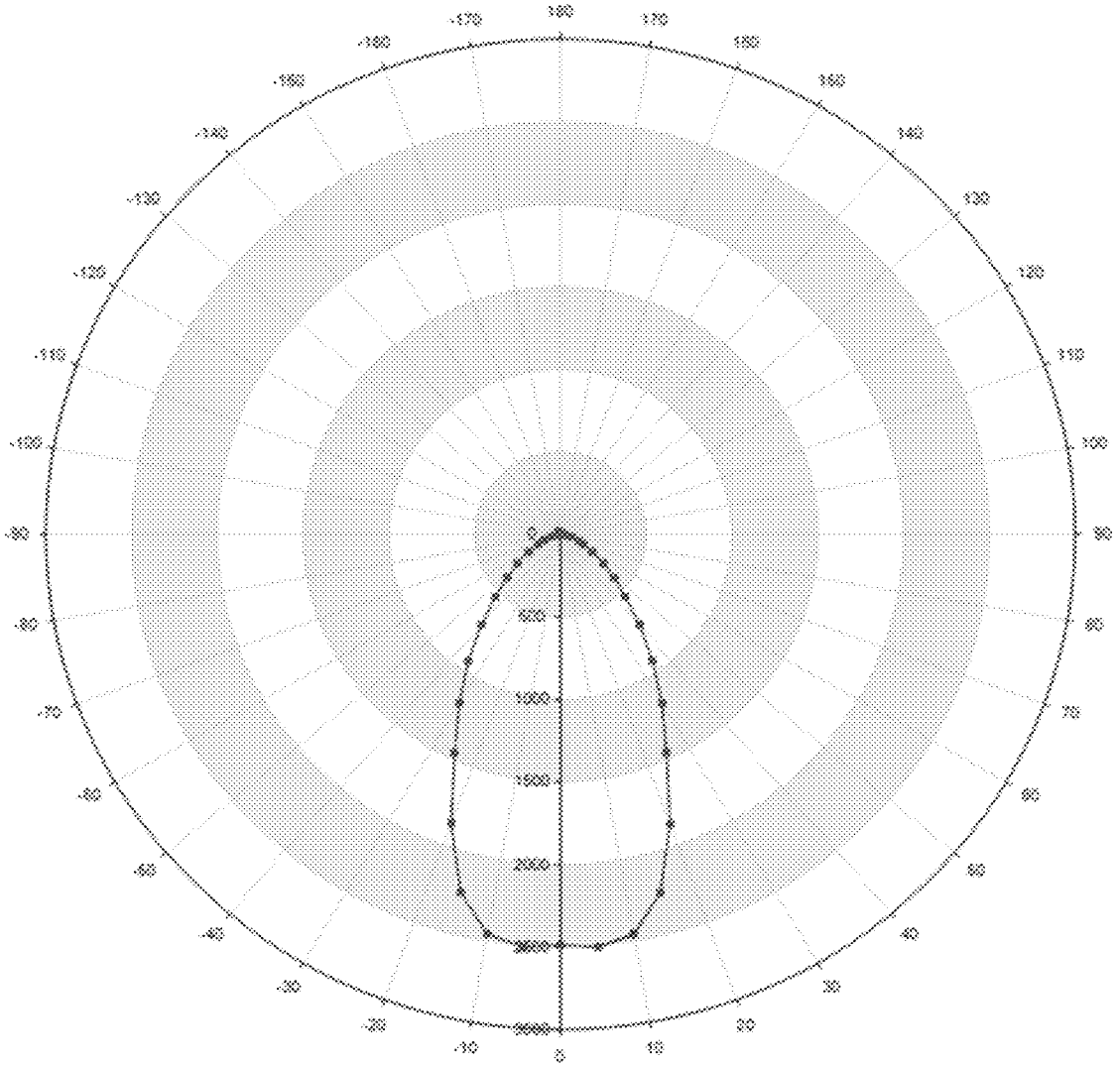

Comparative example 1: As shown in FIG. 4, the light distribution element is a circular ring with a diameter of 50 mm, and the circumferential density of light emitters is 3 per centimeters. The light distribution curve is shown in FIG. 6I.

Figure 5:
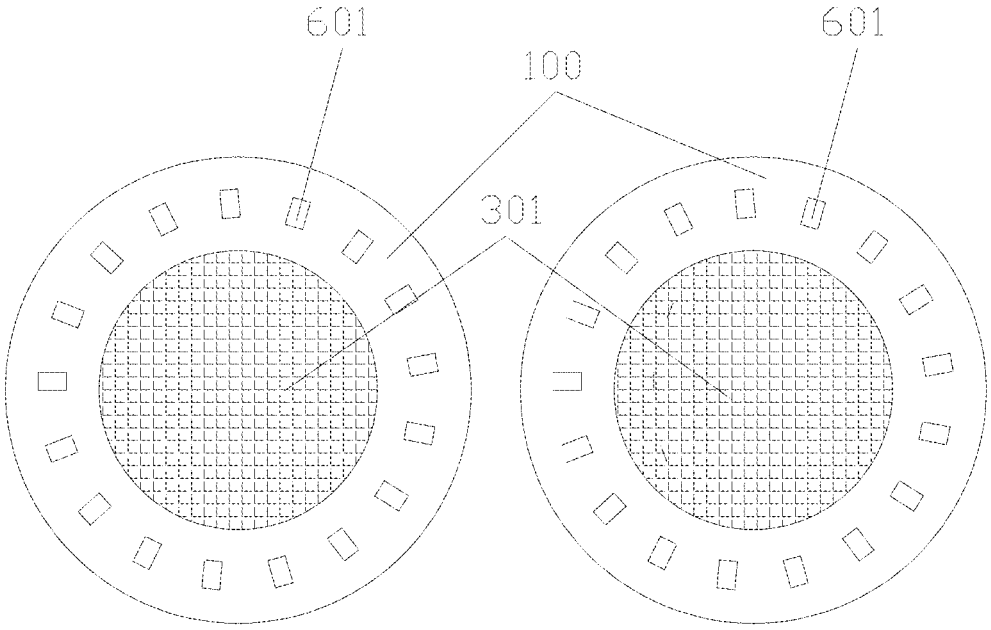
FIG. 5 schematically illustrates another light distribution element in the prior art.
Figure 6J:
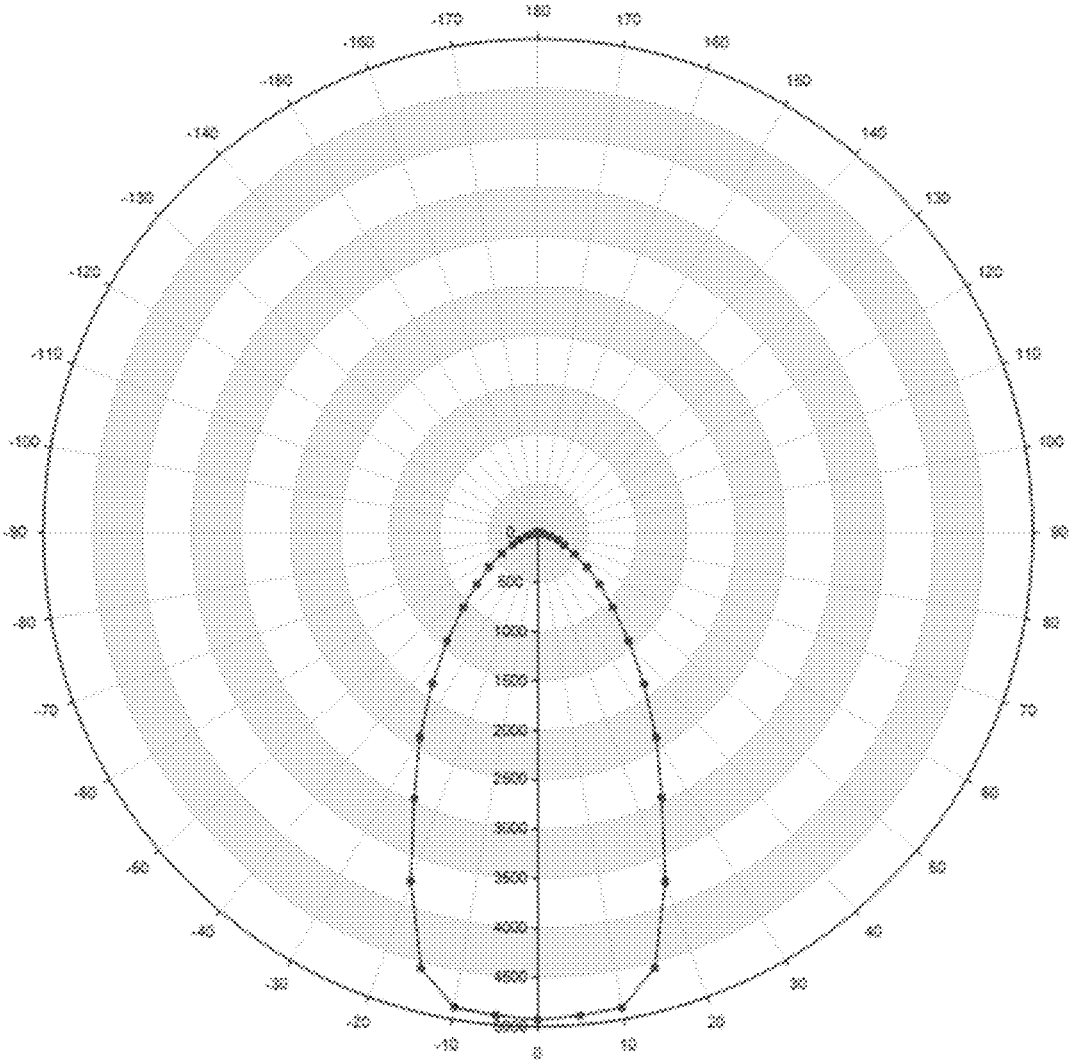

Comparative example 2: As shown in FIG. 5, the light distribution element is a combination of two independent circular rings, each of the circular rings has a diameter of 50 mm, and the circumferential density of light emitters is 4 per centimeters. The light distribution curve is shown in FIG. 6J.

TABLE 1

| | Beam angle/° | Central light intensity/cd | Spot diameter/mm |
|---|---|---|---|
| Example 1 | 57.5 | 2496 | 410 |
| Example 2 | 57.9 | 2495 | 410 |
| Example 3 | 58.6 | 2467 | 410 |
| Example 4 | 56.7 | 2546 | 390 |
| Example 5 | 57.4 | 2529 | 400 |
| Example 6 | 58.6 | 4931 | 420 |
| Example 7 | 58.8 | 4921 | 420 |
| Example 8 | 58.7 | 4930 | 420 |
| Comparative Example1 | 57.8 | 2487 | 410 |
| Comparative Example2 | 58.7 | 4931 | 420 |

In Examples 1-5, a plurality of subsections are translated to form a virtual circumference. The light distribution element of Comparative Example 1 is a circular ring. The diameter of the virtual circumference and the circumferential density of the light emitters are the same as the circular diameter of the light distribution element and the circumferential density of the light emitters of Comparative Example 1. It can be seen from Table 1 that the beam angle, central light intensity and spot diameter of Examples 1-5 are almost the same as those of the comparative example, which indicates that the lamps obtained according to the technical solutions of the present application can exhibit good lighting effect.

In Examples 6-8, a plurality of subsections are translated to form two virtual circumferences. The light distribution element of Comparative Example 2 is composed of two independent circular rings. The diameter of the virtual circumference and the circumferential density of the light emitters are the same as the circular diameter of the light distribution element and the circumferential density of the light emitters of Comparative Example 2. It can be seen from Table 1 that the beam angle, central light intensity and spot diameter of Examples 6-8 are almost the same as those of the comparative example, which indicates that the lamps obtained according to the technical scheme of the present application can exhibit good lighting effect.

In one example, the plurality of subsections are moved to form one or more virtual circumferences.

In one example, the plurality of subsections are spliced to form at least one virtual circumference by translation.

In one example, a shape formed by mutual combination of the plurality of subsections is a symmetric shape.

In one example, central angles of the plurality of subsections are identical.

In one example, a central angle of at least one of the plurality of subsections is not identical to that of the remaining subsections.

In one example, the number of the plurality of subsections is greater than or equal to 3, and the subsections with larger central angle are distributed around peripheries of the subsections with smaller central angle.

In one example, the central angle is greater than or equal to 45°.

In one example, diameters of the plurality of subsections are identical.

In one example, in a shape formed by mutual combination of the plurality of subsections, a ratio of a center distance between two subsections with a farthest distance to a diameter of the virtual circumference ranges from 0.5:1 to 5:1.

In one example, among the plurality of subsections, a diameter of at least one subsection is smaller than that of the remaining subsections.

In one example, the number of the plurality of subsections is greater than or equal to 3, and the subsections with larger diameter are distributed around peripheries of the subsections with smaller diameter.

In one example, in a shape formed by mutual combination of the plurality of subsections, a ratio of a center distance between two subsections with a farthest distance to a diameter of the virtual circumference with the largest diameter is greater than or equal to 1:1 and less than or equal to 10:1.

In one example, at least one of the plurality of subsections includes a light-shielding region and a light-transmitting region, wherein the light-shielding region is close to a center of the circumference, and the light-transmitting region is radially outside the light-shielding region.

In one example, a refraction pattern is constructed in the light-shielding region to realize light shielding.

In one example, a circumferential density of the light emitters along a circumferential extension direction of the subsections is 2-5 per centimeters.

Compared with the prior art, the present application has the following beneficial effects: the light distribution element of the present application includes a plurality of subsections combined with each other, so that the lamp can be configured to provide a special-shaped configuration to be used in a special-shaped space. In addition, the lamp equipped with this light distribution element also exhibits a good lighting effect.

The above description is only examples of the present invention, and is not intended to limit the present invention. Various modifications and changes can be made in the present application to those skilled in the art. Any modification, equivalent substitution, improvement, etc. made within the spirit and principle of the present application should be included within the scope of the claims of the present application.

The invention claimed is:

1. A light distribution element, comprising a plurality of subsections combined with each other, each of the plurality of subsections is a part of a circumference, wherein the plurality of subsections is configured to be located on at least one virtual circumference by movement, wherein a central angle of at least one of the plurality of subsections is not identical to that of the remaining subsections.

2. The light distribution element according to claim 1, wherein the plurality of subsections are moved to form one or more virtual circumferences.

3. The light distribution element according to claim 1, wherein the plurality of subsections are spliced to form at least one virtual circumference by translation.

4. The light distribution element according to claim 3, wherein a shape formed by mutual combination of the plurality of subsections is a symmetric shape.

5. The light distribution element according to claim 3, wherein central angles of some subsections of the plurality of subsections are identical.

6. The light distribution element according to claim 3, wherein the central angle of the at least one of the plurality of subsections is smaller than central angles of the remaining subsections.

7. The light distribution element according to claim 1, wherein the number of the plurality of subsections is greater than or equal to 3, and the subsections with larger central angle are distributed around peripheries of the subsections with smaller central angle.

8. The light distribution element according to claim 5, wherein the central angle is greater than or equal to 45°.

9. The light distribution element according to claim 3, wherein diameters of the plurality of subsections are identical.

10. The light distribution element according to claim 9, wherein in a shape formed by mutual combination of the plurality of subsections, a ratio of a center distance between two subsections with a farthest distance to a diameter of the virtual circumference ranges from 0.5:1 to 5:1.

11. The light distribution element according to claim 3, wherein among the plurality of subsections, a diameter of at least one subsection is smaller than that of the remaining subsections.

12. The light distribution element according to claim 11, wherein the number of the plurality of subsections is greater than or equal to 3, and the subsections with larger diameter are distributed around peripheries of the subsections with smaller diameter.

13. The light distribution element according to claim 12, wherein in a shape formed by mutual combination of the plurality of subsections, a ratio of a center distance between two subsections with a farthest distance to a diameter of the virtual circumference with the largest diameter is greater than or equal to 1:1 and less than or equal to 10:1.

14. The light distribution element according to claim 3, wherein at least one of the plurality of subsections comprises a light-shielding region and a light-transmitting region, wherein the light-shielding region is close to a center of the circumference, and the light-transmitting region is radially outside the light-shielding region.

15. The light distribution element according to claim 14, wherein a refraction pattern is constructed in the light-shielding region to realize light shielding.

16. A lamp, comprising a plurality of light emitters and the light distribution element comprising a plurality of subsections combined with each other, each of the plurality of subsections is a part of a circumference, wherein the plurality of subsections is configured to be located on at least one virtual circumference by movement, wherein a central angle of at least one of the plurality of subsections is not identical to that of the remaining subsections, wherein the plurality of light emitters are arranged corresponding to the plurality of subsections, and wherein the lamp further comprises a lamp panel on which the plurality of light emitters are fixed, and the light distribution element is fixedly engaged with the lamp panel to cover the corresponding light emitters.

17. The lamp according to claim 16, wherein a circumferential density of the light emitters along a circumferential extension direction of the subsections is 2-5 per centimeters.

* * * * *